United States Patent [19]

Kessels et al.

[11] Patent Number: 4,987,691

[45] Date of Patent: Jan. 29, 1991

[54] DEVICE SYSTEM FOR A DISPLAY PANEL CAPABLE OF DISPLAYING A PLURALITY OF IMAGES SUCCESSIVELY

[75] Inventors: Jac H. J. Kessels; Harry J. M. Weekers, both of Weert, Netherlands

[73] Assignee: Koninklijke Smeets Offset B.V., Netherlands

[21] Appl. No.: 350,931

[22] Filed: May 12, 1989

[30] Foreign Application Priority Data

Feb. 2, 1989 [NL] Netherlands ..... 8900257

[51] Int. Cl.[5] ..... G09F 11/02

[52] U.S. Cl. ..... 40/506; 40/505

[58] Field of Search ..... 40/506, 505, 507, 471, 40/472, 473, 474, 483, 484

[56] References Cited

U.S. PATENT DOCUMENTS

| | | | |
|---|---|---|---|
| 1,555,690 | 9/1925 | Mitnitzky | 40/505 |
| 1,857,387 | 5/1932 | Lippe-Lipshi | 40/505 X |
| 3,304,638 | 2/1967 | Grandell et al. | 40/505 |
| 3,826,027 | 7/1974 | Abbema | 40/505 X |

*Primary Examiner*—Laurie K. Cranmer

*Attorney, Agent, or Firm*—Peter L. Michaelson

[57] ABSTRACT

A drive system for a display panel has a plurality of rotary, triangular columns positioned in parallel, juxtaposed relationship and whose corresponding side faces in the different positions of the columns can display a plurality of different images. The columns are supported for rotation at both ends and are each provided at one end with a substantially triangular rotation element. Displacement means driven by a common drive unit rotate the successive rotation elements consecutively through about 120°.

6 Claims, 1 Drawing Sheet

DEVICE SYSTEM FOR A DISPLAY PANEL CAPABLE OF DISPLAYING A PLURALITY OF IMAGES SUCCESSIVELY

This invention relates to a drive system for a display panel comprising a plurality of triangular columns mounted for rotation about their longitudinal axes, said columns being positioned in parallel juxtaposed relationship, and each being provided at one end with a substantially triangular rotation element, and displacement means driven by a common drive unit for rotating the successive rotation elements consecutively through about 120°.

A drive system of this type is disclosed in European patent application No. 0261089 and is especially suitable for successively displaying e.g. three different advertisements by means of the side faces of the columns, said advertisements being formed by the corresponding faces of the triangular columns, each showing a small part of the total advertisement. The known drive system functions well in practice but has the drawback that it is rather expensive, since it comprises a great many parts and a complex supporting section for the drive elements of the separate columns. This high cost price is especially a drawback when the display panel is used e.g. only for a single advertising campaign and is discarded afterwards.

Consequently, it is an object of the present invention to provide a drive system for a display panel with a plurality of images to be displayed successively, which system has a particularly low cost price and yet functions in a reliable manner, so that it can be used for advertisements of a temporary nature without any objections.

To that effect, the present invention provides a drive system of the above described type wherein the sides of the rotation elements, between the corners, are concave and wherein the drive means comprise an endless belt coupled with the common drive unit, and which is provided with at least one slot extending longitudinally of the belt, said slot being adapted to engage a belt-facing portion of a rotation element near a corner thereof so as to rotate the same, and with a leading element belonging to the slot, said element, as viewed in the direction of travel of the belt being disposed at such an interspace ahead of the slot that, through engagement with a corner portion of the rotation element, it causes said element to rotate to such an extent that—as viewed in the direction of travel of the belt—the preceding corner portion is rotated into the slot, after which said portion is taken along by an end edge of the slot until the angle of 120° is completed.

The slot preferably has a rectangular shape, so that its trailing end edge engages with the rotation element, while the leading elements preferably take the form of belt-mounted, elongate metal strips curved at one end, the curved portion of which extends away from the belt in the direction of the rotation elements. By virtue of the features according to the present invention there is provided a very simple drive system manufacturable inexpensively, which in practice, however, has proved to function in a highly reliable manner.

One embodiment of the present invention will now be described, by way of example, with reference to the accompanying drawings, in which.

Figure 1:
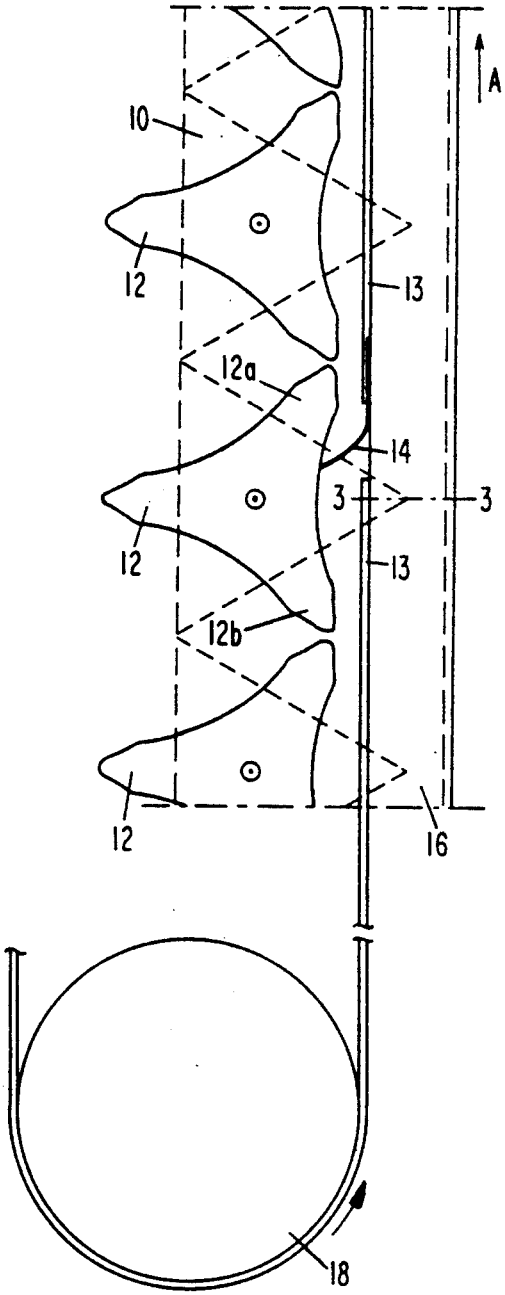
FIG. 1 is a top view of a part of the drive system according to the present invention.
Figure 2:
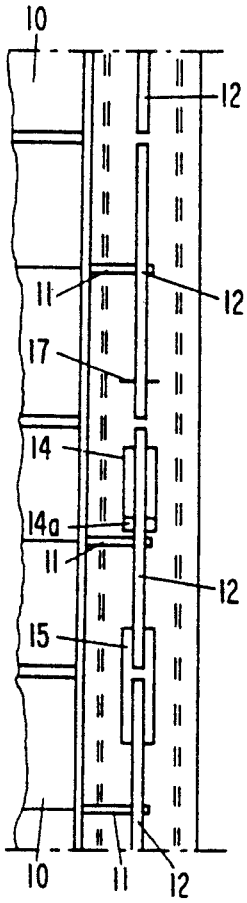
FIG. 2 is a side view of the system according to FIG. 1.

FIGS. 1 and 2 show parts of the triangular columns 10 provided on each of their faces with parts of images in such a manner that the faces oriented to the left in FIG. 1 jointly show a (commercial) notice. By rotating all columns through 120°, the next advertisement is shown and by again rotating them through 120° a third, after which the cycle can begin again. At the ends not shown, columns 10 are supported for rotation in a frame. The construction of such a frame can be effected in various, known per se manners and, consequently, will not be described herein. At the ends shown in FIG. 2, columns 10 are provided with shafts 11, which likewise are supported in known per se manner in a frame, not shown in the figures. Each shaft 11 is fitted with a triangular rotation element 12. As clearly shown in FIG. 1, the sides of each of the rotation elements 12 are concave between successive corners, so that the corners get a slightly more pointed shape. An endless belt 13, which may be made for instance of textile, runs around drums which are arranged near the first and the last rotation element 12, substantially in alignment therewith. One of said drums is indicated by numeral 18 in FIG. 1. For instance, drum 18 is driven by a drive motor, not shown, for moving the belt 13 in the direction indicated by an arrow A in FIG. 1.

Figure 3:
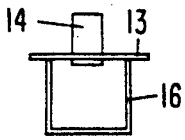
FIG. 3 is a cross-sectional view taken on the line 3—3 of FIG. 1.

As clearly shown in FIGS. 2 and 3, belt 13 is provided with a rectangular leading element 14 mounted on the belt and at its free end curved away from the belt, and a drive slot 15 aligned with, and spaced some distance from it. The back of the belt is supported by a supporting section 16, which prevents the belt from sagging.

The leading element 14 is preferably made of a flexible material, e.g. of metal, so that at the end of the drive system where belt 13 runs around the drums, such as 18, it can follow the drum surface without any problems. It has been found to be advantageous to provide a recess **14*a* in the portion of belt 13 situated behind the projecting part of the leading element, said recess being adapted to accommodate at least a part of the projecting portion of the leading element, to thereby preclude failure in belt transport as the leading element is rounding the drum. It is thus also possible for the portion of the leading element adjoining belt 13 to rest against the back of the belt. Leading element 14 is attached to the belt e.g. through a staple 17**.

The operation of the drive system is as follows. The drive belt 13 travels in the direction of arrow A in FIG. 1. When leading element 14 passes a rotation element 12, the leading element will rotate the rotation element through a relatively small angle, as it displaces the corner portion of said rotation element, indicated at **12*a* in FIG. 1, counter-clockwise. As a result, the corner portion 12*b* rotates into slot 15, through a proper choice of the distance between leading element 14 and slot 15, after which the rotation element rotates through the full 120°, because corner portion 12*b* is taken along by the back edge of slot 15. Upon further movement of the belt, the next rotation element, as viewed in the direction of travel of the belt, is rotated through 120°, etc., so that after a passage of leading element 14 and the next slot 15 along all rotation elements 12, the joint side faces of columns 10** show another advertisement. After the following passage, the third group of side faces display a third advertisement.

It is observed that leading element 14, when reaching a rotation element, will first also move corner 12*b* thereof in upward direction. However, this has no further effect, since corner 12*a* then strikes belt 13, which cannot be pushed aside due to supporting section 16 and has no slot at that location.

Naturally, it is possible to provide on belt 13 several pairs of displacement elements, each consisting of a leading element 14 and a slot 15, to thereby obtain a quicker alternation of the images shown by columns 10. These pairs should then be substantially aligned on the belt.

Figure 4:
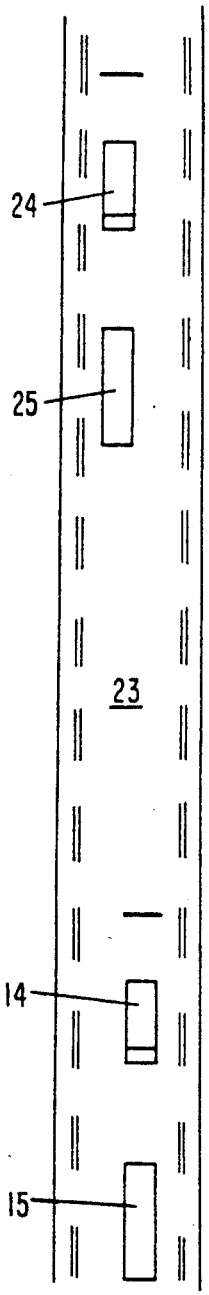
FIG. 4 shows a different embodiment of the system according to the present invention.

FIG. 4 shows a variant wherein such pairs of displacement elements, such as 14, 15 and 24, 25, are not aligned. This makes it possible to have one drive system to drive different groups of columns, so that different groups of continuously changing advertisements can be displayed on one display panel. Rotation elements 12 of the various groups of columns are then placed at different levels relative to belt 13. In this manner, as many as seven different advertisements, each in turn consisting of three different images, can be shown on a display panel.

We claim:

1. A drive system for a display panel comprising a plurality of triangular columns, each of said columns having a longitudinal axis, wherein said columns are mounted for rotation about their corresponding longitudinal axes and positioned in a parallel, juxtaposed relationship, each of the columns being provided at one end thereof with a substantially triangular rotation element so as to form a plurality of successive rotation elements, said system also having displacement means driven by a common drive unit for rotating the successive rotation elements consecutively through an angle of approximately 120°, characterized in that:

each of said rotation elements has a plurality of corners and a concave side situated between two adjacent ones of said corners; and the displacement means comprise:

an endless belt coupled with said common drive unit and provided with at least one slot extending longitudinally through the belt, wherein said slot is adapted to engage a belt-facing portion of successive ones of said rotation elements situated near one of said corners thereof in order to successively rotate each one of rotation elements; and a leading element associated with said slot and having a free end projecting therefrom and oriented towards one of said rotation elements, wherein said leading element is disposed on said belt at an interspace ahead of the slot such that as said belt travels said projecting end of said leading element engages with a portion of one of said corners of said one rotation element so as to cause a portion of a preceding one of said corners of said one rotation element to rotate into said slot after which said preceding corner portion is conveyed by movement of an end edge of said slot until said one rotation element rotates through an angle of approximately 120°.

2. A drive system as claimed in claim 1, characterized in that the slot has a rectangular shape.

3. A drive system as claimed in claim 1, characterized in that the leading element consists of a belt-mounted, elongate metal strip curved at one end whose curved portion extends away from the belt in the direction of the rotation element.

4. A drive system as claimed in claim 1, characterized in that the belt is provided with several pairs of drive means, each pair including a leading element and a slot.

5. A drive system as claimed in claim 4, characterized in that the pairs of drive means are aligned with each other longitudinally of the belt.

6. A drive system as claimed in claim 4, characterized in that groups consisting of one or more pairs of drive means are situated at different levels on the belt and that associated groups of rotation elements are disposed at corresponding levels.

* * * * *